US011076672B2

(12) United States Patent
Wojczak

(10) Patent No.: US 11,076,672 B2
(45) Date of Patent: Aug. 3, 2021

(54) HAIR DRYER WITH SIDE SWITCHES

(71) Applicant: CONAIR CORPORATION, Stamford, CT (US)

(72) Inventor: Sophia Wojczak, Harrison, NY (US)

(73) Assignee: CONAIR CORPORATION, Stamford, CT (US)

( * ) Notice: Subject to any disclaimer, the term of this patent is extended or adjusted under 35 U.S.C. 154(b) by 0 days.

(21) Appl. No.: 16/707,030

(22) Filed: Dec. 9, 2019

(65) Prior Publication Data

US 2021/0169196 A1 Jun. 10, 2021

(51) Int. Cl.
*A45D 20/12* (2006.01)
*A45D 20/30* (2006.01)

(52) U.S. Cl.
CPC ..... *A45D 20/12* (2013.01); *A45D 20/30* (2013.01)

(58) Field of Classification Search
CPC ..... A45D 20/12; A45D 20/30
USPC ..... 34/95–100
See application file for complete search history.

(56) References Cited

U.S. PATENT DOCUMENTS 3,986,272 A * 10/1976 Feierabent ..... A45D 20/12 34/97
D246,730 S 12/1977 Tomaro
4,196,343 A * 4/1980 Han ..... A45D 20/12 200/332.2
4,198,556 A * 4/1980 Crowley ..... A45D 20/12 132/212
4,603,246 A * 7/1986 Costa ..... A45D 20/12 34/97
D290,528 S 6/1987 Muller
4,904,847 A * 2/1990 Kosaka ..... A45D 20/12 392/384
5,394,620 A * 3/1995 Chimera ..... A45D 20/10 34/97
D360,282 S 7/1995 Anzuoni, Jr. et al.
5,590,475 A * 1/1997 Andis ..... A45D 20/12 34/90
5,649,370 A * 7/1997 Russo ..... A45D 20/12 34/97
5,727,331 A * 3/1998 Thaler ..... A45D 20/12 34/97
5,884,008 A * 3/1999 Goldberg ..... A45D 20/12 206/320
6,792,692 B1 * 9/2004 Takizawa ..... A45D 20/12 34/283
7,946,056 B2 * 5/2011 Kroll ..... A45D 20/42 34/96
D649,711 S 11/2011 Strollo et al.
9,364,765 B2 * 6/2016 Kane ..... A63H 3/44
D775,417 S 12/2016 Cho
D832,509 S 10/2018 Kan
10,104,949 B2 * 10/2018 Torres ..... A45D 19/16
2015/0113823 A1 4/2015 Lee
2015/0192324 A1 7/2015 Takemoto

* cited by examiner

*Primary Examiner* — Stephen M Gravini
(74) *Attorney, Agent, or Firm* — Grogan, Tuccillo & Vanderleeden, LLP

(57) ABSTRACT

A hair dryer include a housing having a handle portion, a head portion located an upper end of the handle, and a nozzle portion extending from the head portion, and at least one side switch located on a side of the head portion or the nozzle portion. The at least one switch is actuatable to effect a momentary deactivation of the hair dryer.

5 Claims, 11 Drawing Sheets

HAIR DRYER WITH SIDE SWITCHES

FIELD OF THE INVENTION

The present invention relates generally to hair drying devices and, more particularly, to a hair dryer having side switches for selectively and momentarily interrupting operation of the hair dryer.

BACKGROUND OF THE INVENTION

A hair dryer is generally designed to emit a concentrated flow of heated air from a nozzle to quickly dry hair. In some hair dryers, a user can modify the flow and/or the temperature of the air emitted from the nozzle. Conventionally, users or consumers use the combination of a brush and a hair dryer to dry, straighten and smooth their hair. The user pulls the hair tight and keeps tension on the hair with the brush. The user then applies heated air directionally onto the tensioned hair with the hair dryer. This process requires two tools (i.e., the brush and the hair dryer) and two hands.

While known hair dryers are generally suitable for what is regarded as ordinary performance, such hair dryers have certain limitations. For example, in the middle of a hair drying process, users will often place the hair dryer between their knees or on a countertop in order to free up their hands to adjust hair or to manipulate a brush, hair clip or the like. In such non-use position, the hair dryer remains on unless a user first deactivates the hair dryer by depressing or flipping an off switch. In such on position, when held between the knees or placed on the countertop, heated air continues to be emitted, which may undesirably blow towards the user, the floor or the countertop, which is undesirable.

In view of the above, there is a need for a hair dryer having a mechanism whereby the flow of heated air from the nozzle is momentarily, and automatically, interrupted when held between the knees and/or placed on a countertop or other surface.

SUMMARY OF THE INVENTION

In view of the foregoing, it is an object of the present invention to provide a hair dryer.

It is another object of the present invention to provide a hair dryer having a level of convenience greater than existing hair dryers.

It is another object of the present invention to provide a hair dryer that does not require a user to manually deactivate the hair dryer to cease flow of heat air before placing the hair dryer on a countertop or holding the hair dryer between the legs of the user.

It is another object of the present invention to provide a hair dryer having a mechanism whereby the flow of heated air from the nozzle is momentarily, and automatically, interrupted when held between the knees and/or placed on a countertop or other surface.

These and other objects are achieved by the present invention.

According to an embodiment of the present invention, a hair dryer include a housing having a handle portion, a head portion located an upper end of the handle, and a nozzle portion extending from the head portion, and at least one side switch located on a side of the head portion or the nozzle portion. The at least one switch is actuatable to effect a momentary deactivation of the hair dryer.

According to another object of the present invention, a method of operating a hair dryer includes placing a fan switch in an operational position to initiate a flow of air from a nozzle portion of the hair dryer, placing a heater switch in an operational position to heat the air, and contacting a side switch located on the nozzle portion or a head portion of the hair dryer with a surface or a leg of a user to effect actuation of the side switch, wherein actuation of the side switch effects a momentary deactivation of the hair dryer despite the fan switch and the heater switch being in the operational position.

BRIEF DESCRIPTION OF THE DRAWINGS

The present invention will be better understood from reading the following description of non-limiting embodiments, with reference to the attached drawings, wherein below.

DETAILED DESCRIPTION OF THE PREFERRED EMBODIMENTS

Figure 1:
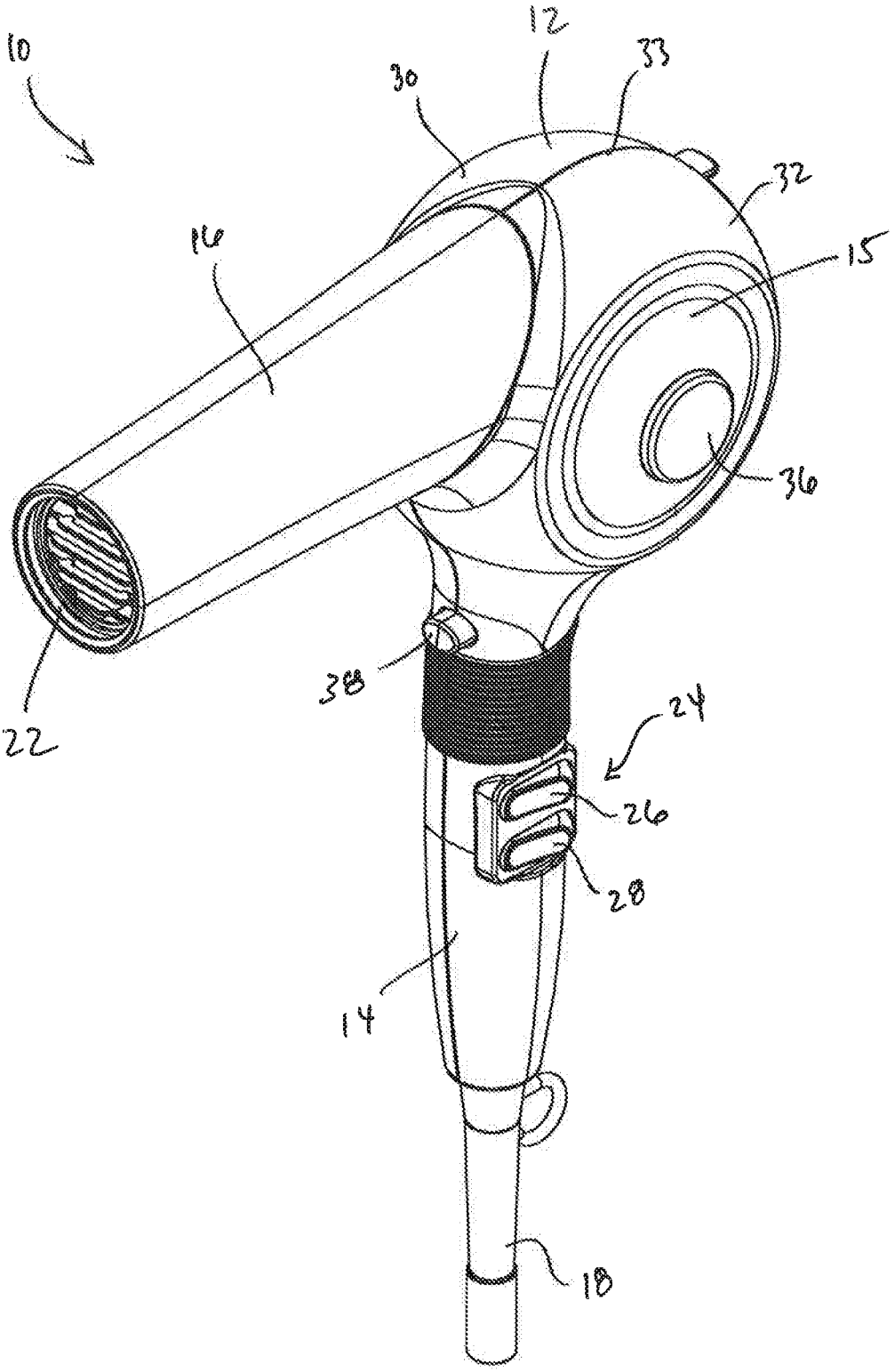
FIG. 1 is a perspective view of a hair dryer according to an embodiment of the present invention.

With reference to FIGS. 1-11, a hair dryer 10 according to an embodiment of the present invention is illustrated. The hair dryer 10 is illustrated as a hand-held, electrically powered hair dryer 10 embodying aspects of the invention as disclosed herein. Referring specifically to FIGS. 1-7, the hair dryer 10 includes a housing or body 12 having a handle portion 14, a head portion 15 connected to an upper end of the handle 14, and a nozzle or barrel 16 connected to, and extending from, the head portion 15. The head portion 15 and nozzle 16 may collectively be referred to as the nozzle portion. As shown therein, the handle 14 is generally elongate, and the nozzle 16 extends generally perpendicularly from the handle. In an embodiment, a diffuser or concentrator (not shown) may be removably attached to the nozzle 16 and configured to further concentrate airflow emitted from the hair dryer 10. A power supply or power cord 18 is connected to the distal, lower end of the handle 14 to provide electricity to the hair dryer 10. The power cord 18 is configured to engage a suitable electrical outlet (e.g., a wall outlet, etc.). However, in other embodiments, any suitable source of electricity may be incorporated into the hair dryer 10, including, but not limited to a battery or rechargeable battery.

Figure 2:
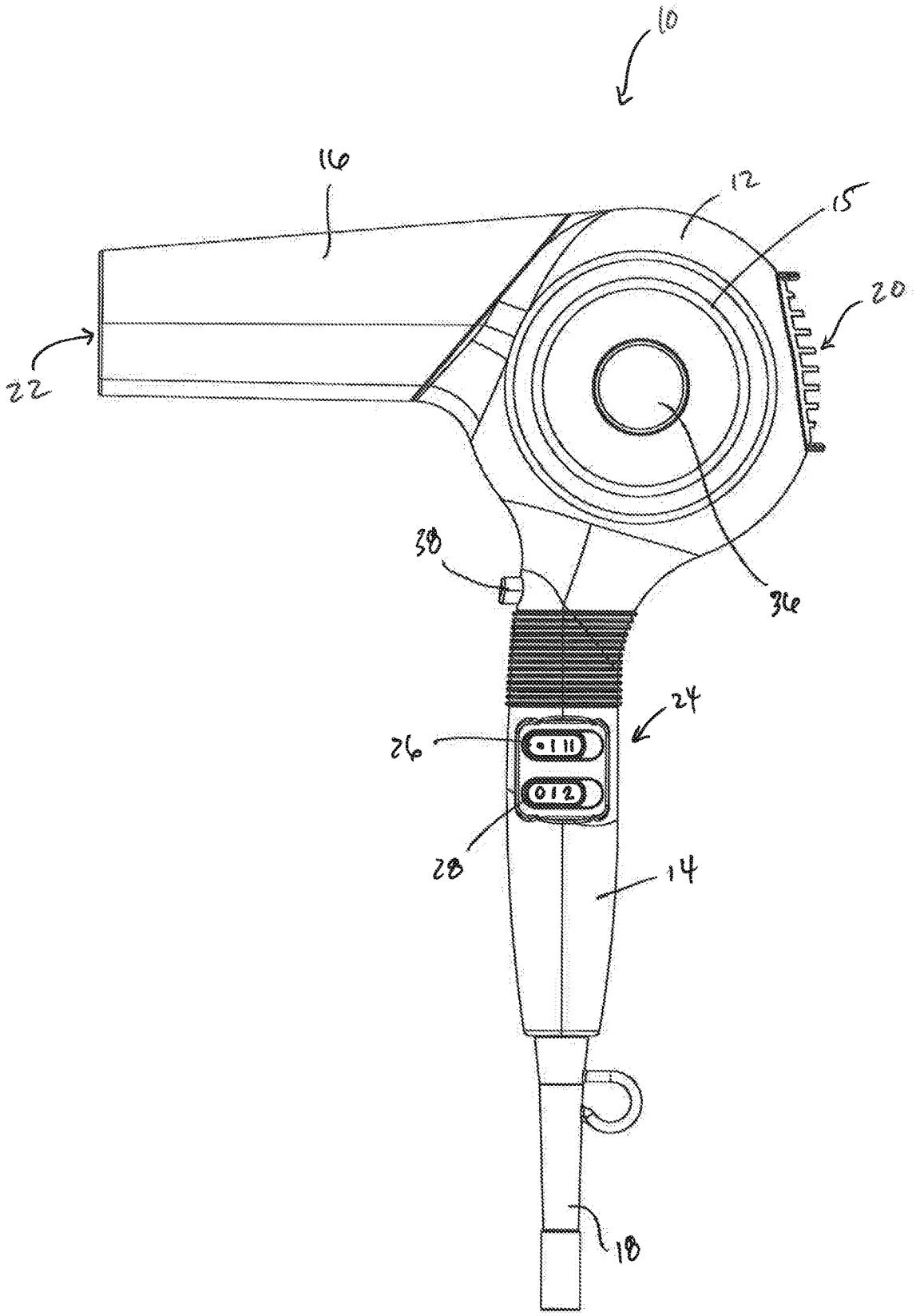
FIG. 2 is a left side elevational view of the hair dryer of FIG. 1.
Figure 3:
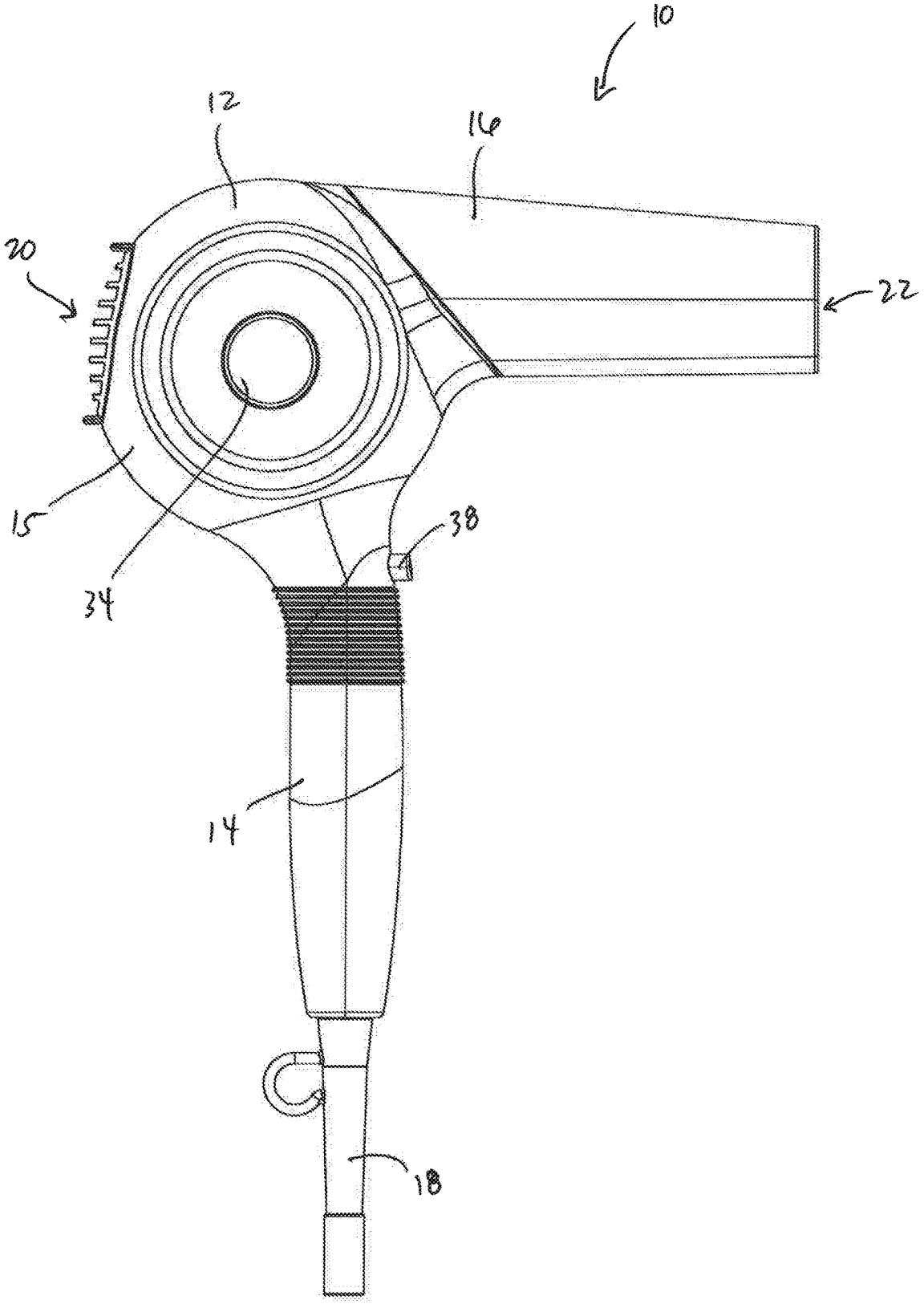
FIG. 3 is a right side elevational view of the hair dryer of FIG. 1.
Figure 4:
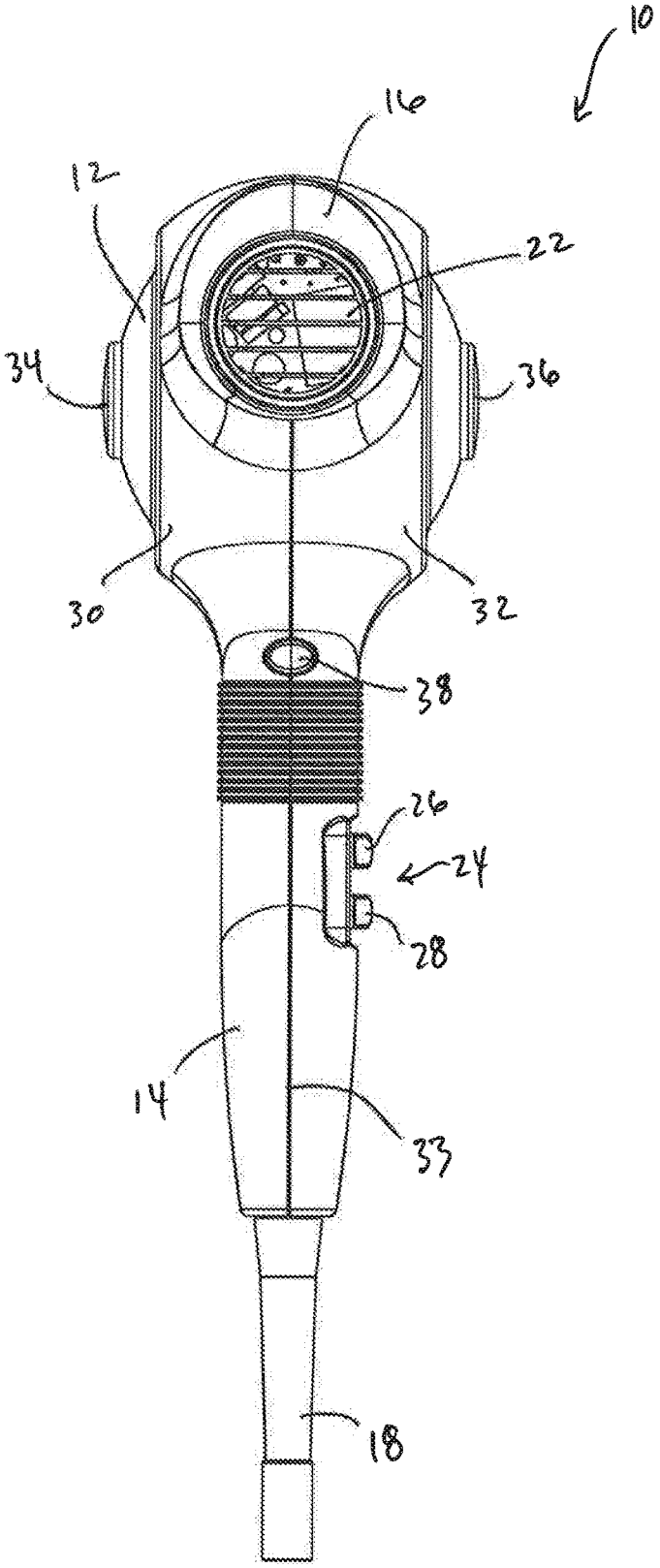
FIG. 4 is a front elevational view of the hair dryer of FIG. 1.

Referring now to FIGS. 2-5, the housing 12 includes an air inlet 20 and an air outlet 22. Air is drawn into the hair dryer 10 through the air inlet 20, where it is concentrated, optionally heated, and emitted through the air outlet 22 in a manner known in the art. To facilitate user operation of the hair dryer 10, the handle 18 includes a user control assembly 24. As illustrated in FIG. 2, the user control assembly 24 includes a plurality of pair of operating switches 26, 28 to control operation of the hair dryer 10. The switch 26 is in electrical communication with a heating element or heating device (not shown) to provide selective operation of the heating element, while the switch 28 is in electrical communication with a motor (not shown) to provide selective operation of a fan. In an embodiment, the switches 26, 28 may be configured as rocker or sliding switches, although other switch configurations or type known in the art may also be utilized without departing from the broader aspects of the invention.

In an embodiment, the switch 26 has three positions, and markings denoting such positions. For example, a first position, marked with a ".", corresponds to an "OFF" state or mode of the heating element, so that unheated air may be expelled from the nozzle 16. A second position, marked with "I", corresponds to a low heat mode of the heating element, for providing low heat as desired. A third position, marked with "II", corresponds to a high heat mode of the heat element, for providing high heat as desired.

The switch 28 similarly has three positions, and markings denoting such positions. For example, a first position, marked with a "0", corresponds to an "OFF" state or mode of hair dryer 10 and/or fan or motor thereof, so that no air flows from the nozzle 16. A second position, marked with "1", corresponds to a low speed mode of the fan, for providing a low flow of air, as desired. A third position, marked with "2", corresponds to a high speed mode of the fan, for providing a high flow of air, as desired.

While the switches 26, 28 are illustrated as having three positions, it is contemplated that the hair dryer 10 and switches 26, 28 may have more than three operational positions, to provide a more granular level of control over the intensity or temperature of the heating element and/or the speed of the fan. In use, the switch 28 is moved to the "1" or "2" position to turn on the fan to initiate airflow, and then switch 26 is moved to the ".", "I" or "II" position for no heat, low heat, or high heat.

Figure 5:
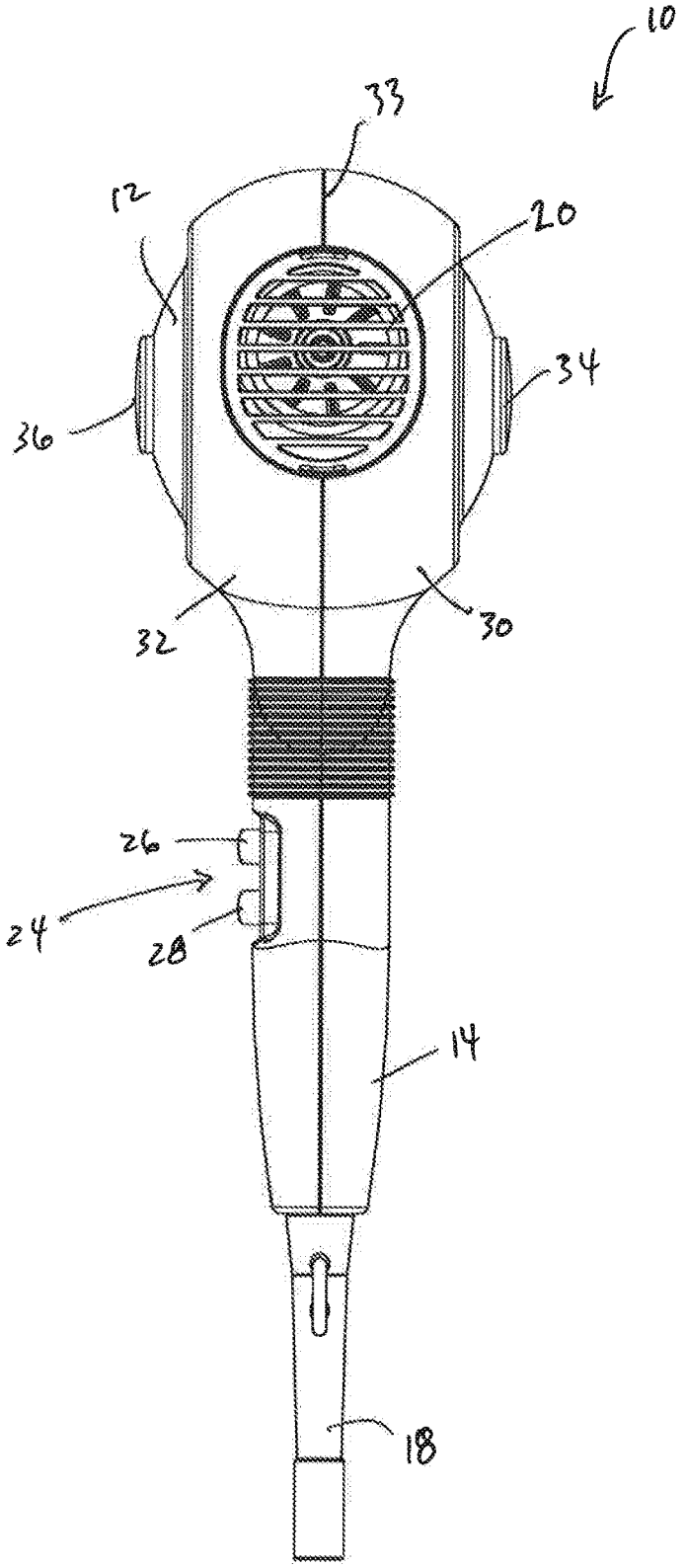
FIG. 5 is a rear elevational view of the hair dryer of FIG. 1.
Figure 6:
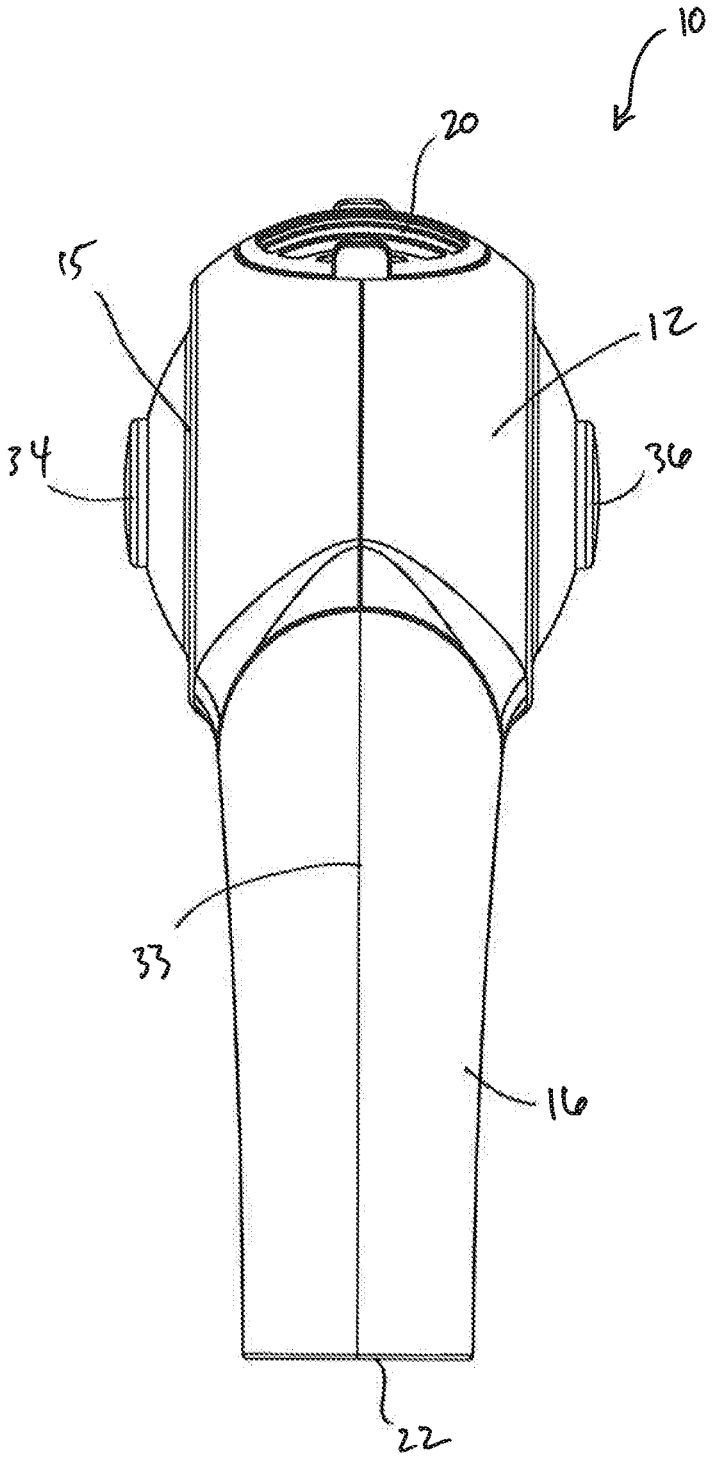
FIG. 6 is a top plan view of the hair dryer of FIG. 1.
Figure 7:
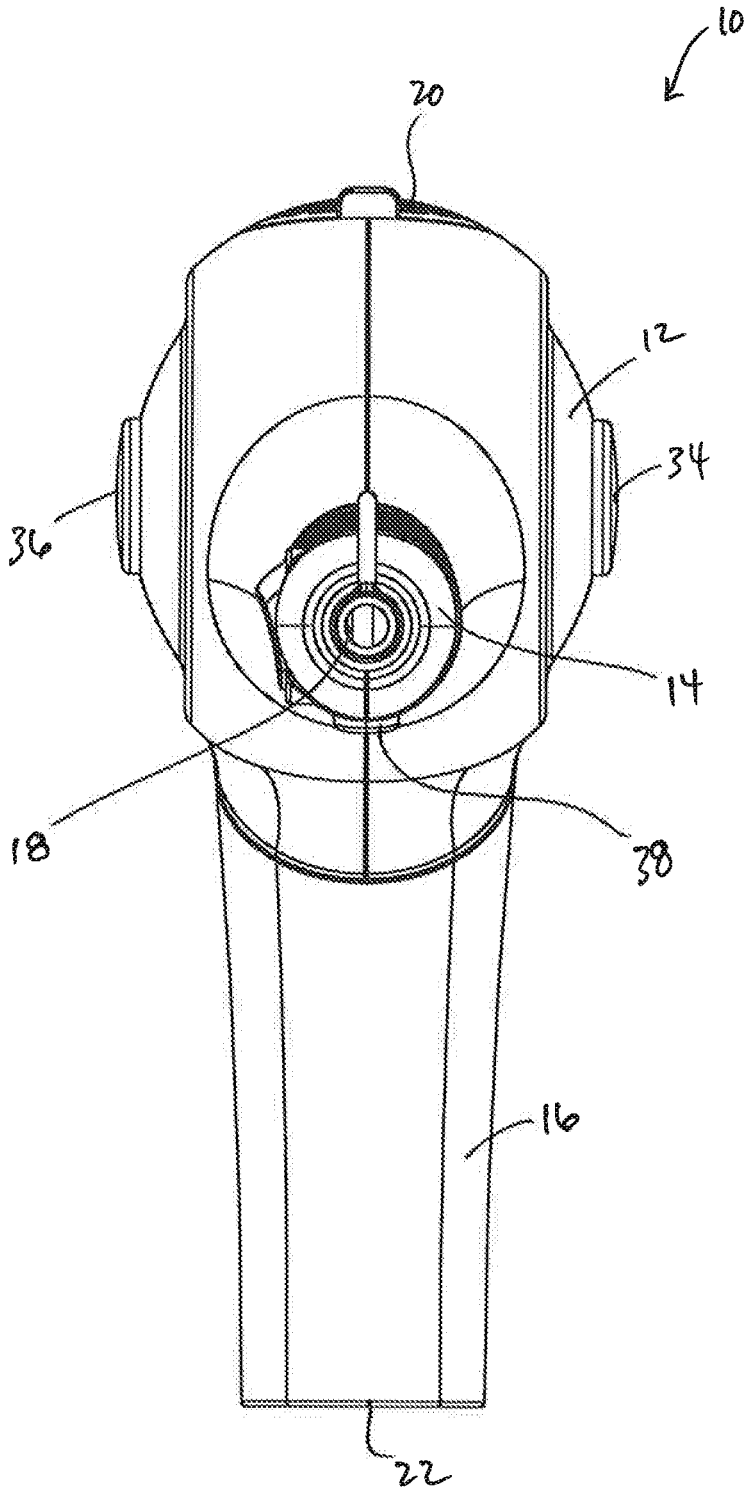
FIG. 7 is a bottom plan view of the hair dryer of FIG. 1.
Figure 8:
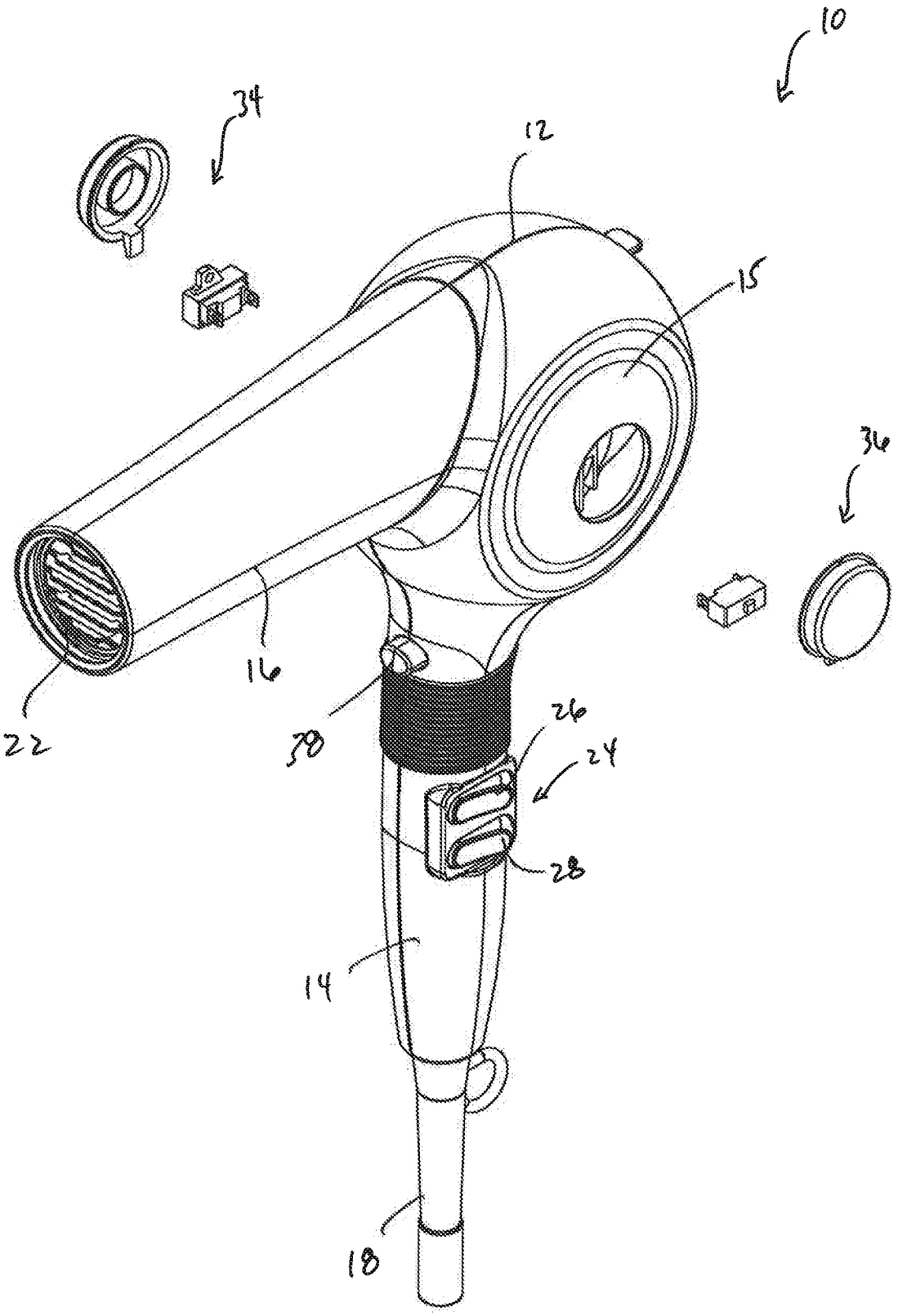
FIG. 8 is a partially exploded, perspective view of the hair dryer of FIG. 1.
Figure 9:
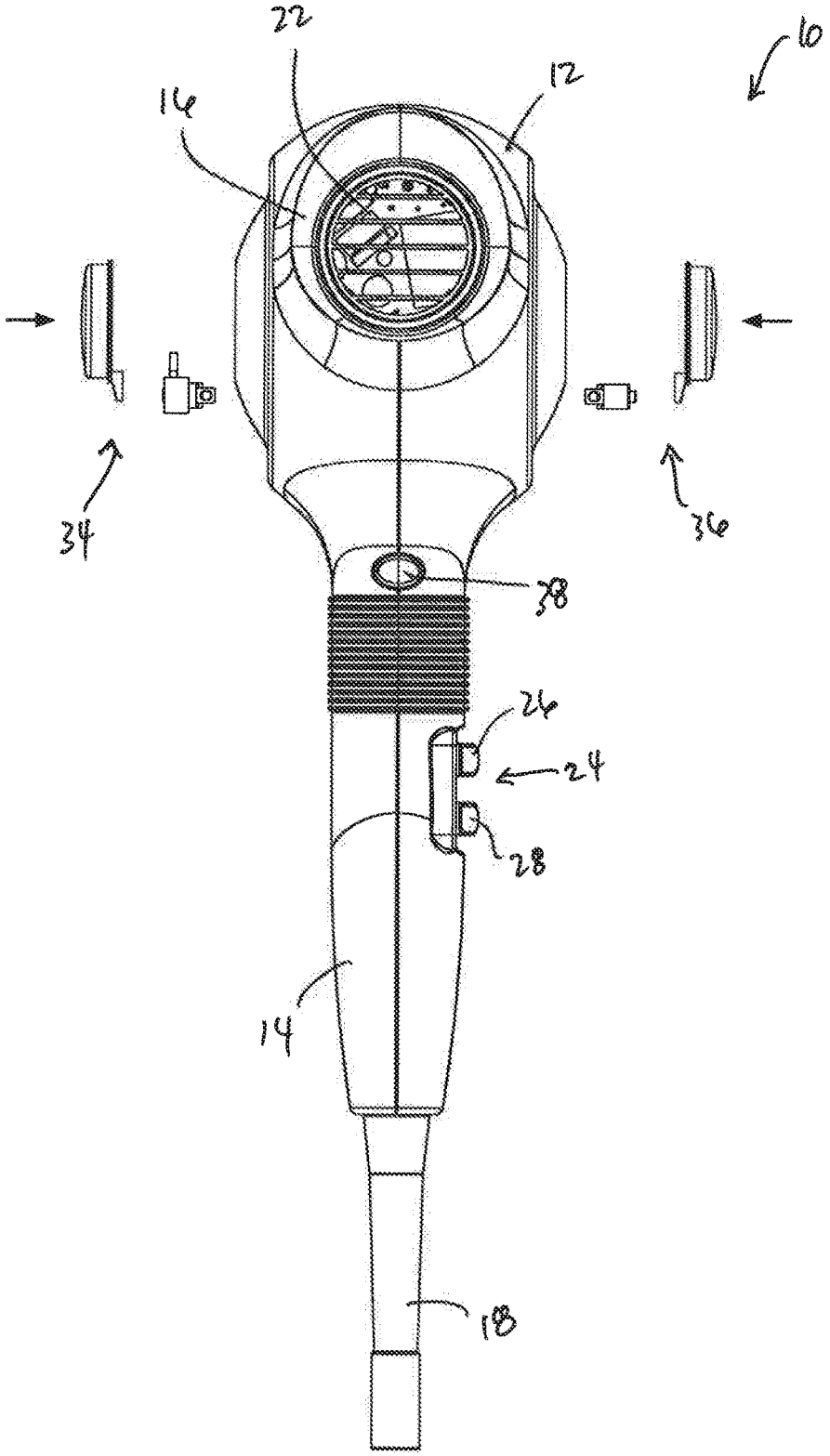
FIG. 9 is a partially exploded, front elevational view of the hair dryer of FIG. 1.
Figure 10:
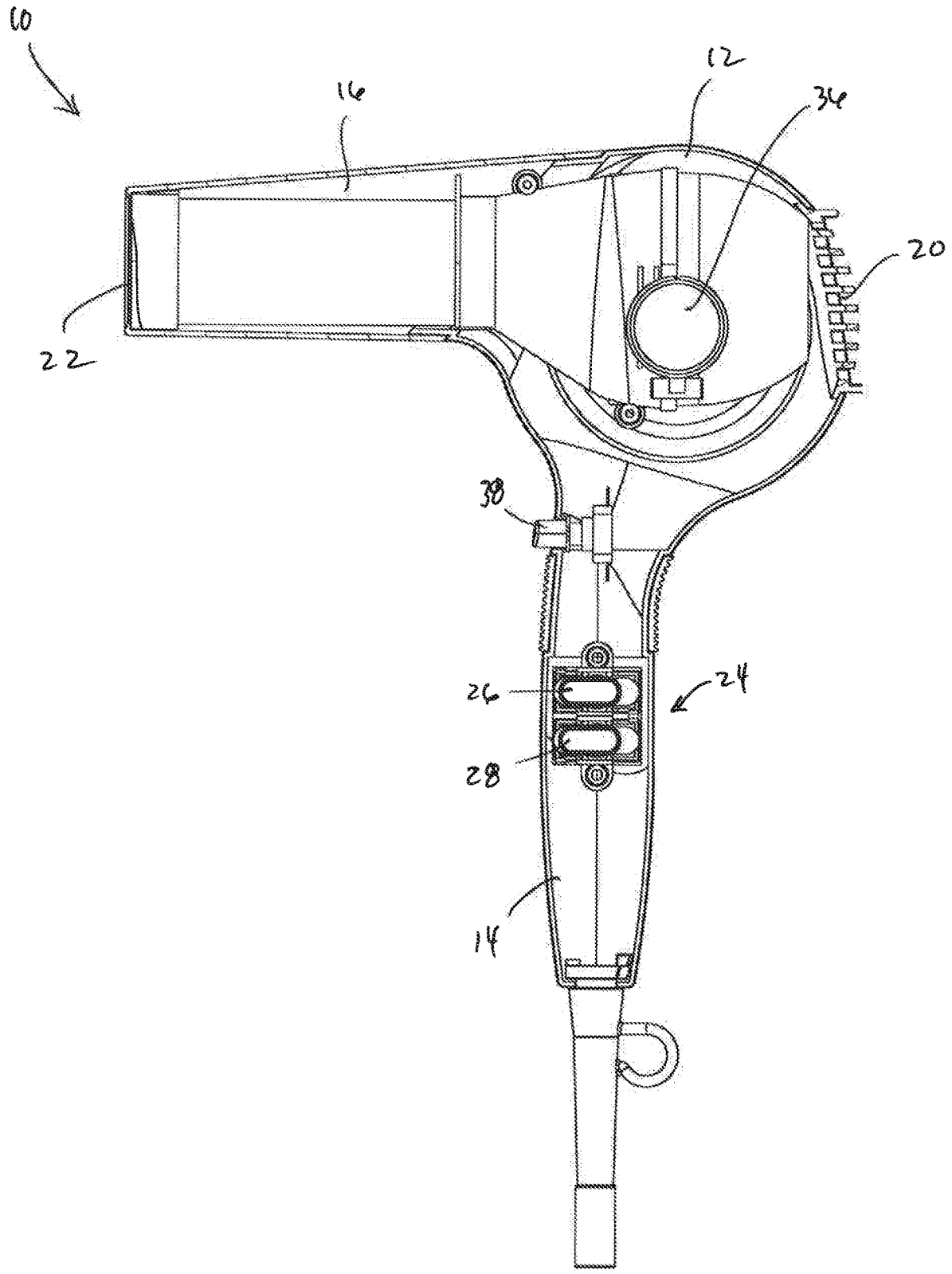
FIG. 10 is a partial cross-sectional, left side view of the hair dryer of FIG. 1.
Figure 11:
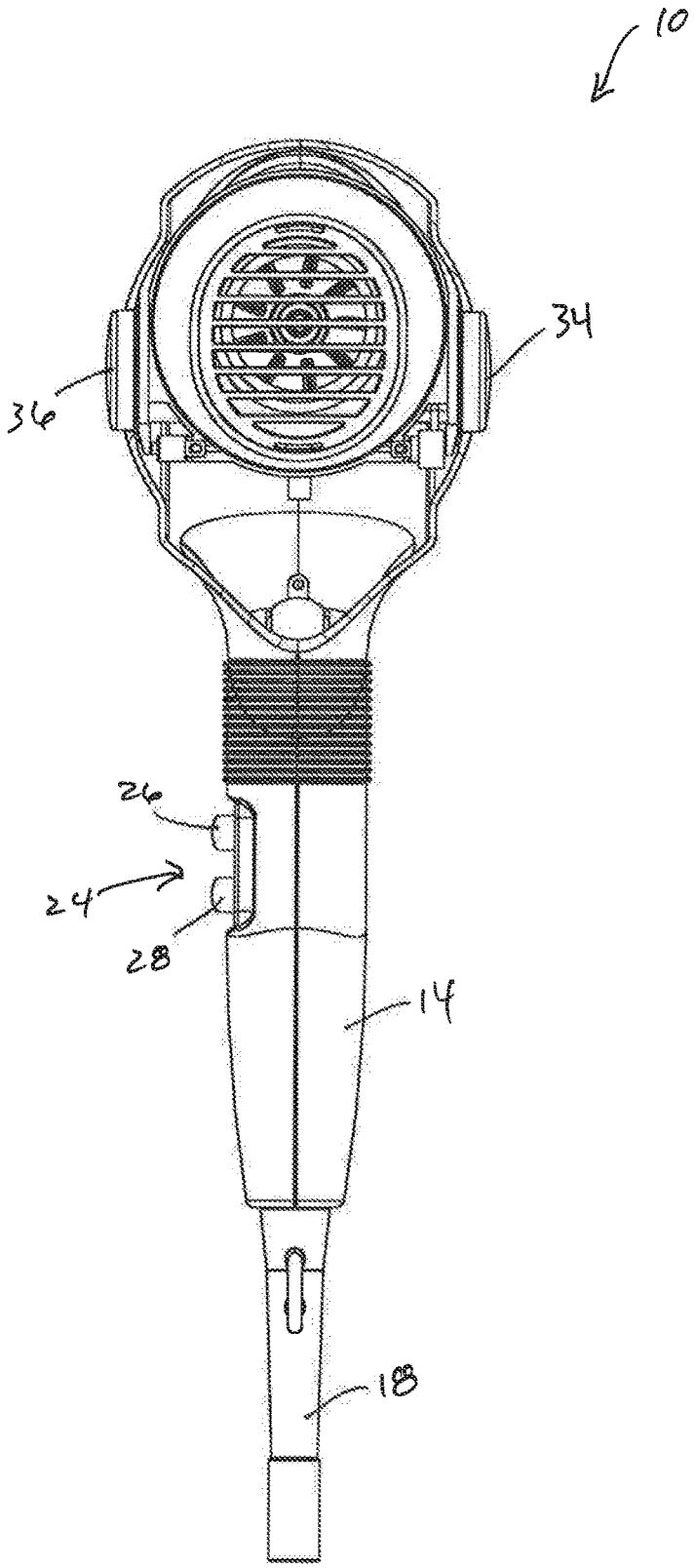
FIG. 11 is a partial cross-sectional, rear view of the hair dryer of FIG. 1.

With further reference to FIGS. 1, 5 and 6, the housing 12 is formed from plurality of housing portions that mate to define the housing 12. As shown therein, the housing 12 includes a first housing or first housing portion 30 and a second housing or second housing portion 32. The first and second housing portions 30, 32 mate at a seam or joint 33 to define the housing 36.

As shown in FIGS. 1-11, the hair dryer 10 additionally includes a pair of switches 34, 36 located on opposing, lateral sides of the hair dryer 10 (e.g., on a head portion from which the nozzle 16 extends). In an embodiment, the switches 34, 36 are formed as spring-biased, depressible buttons. The switches 34, 36 are configured to momentarily shut off the heater and fan motor when actuated (e.g., depressed) so that heat and a flow of air is ceased despite one or both of the switches 26, 28 being in an "ON" or operational position. When the side switches 34, 36 are released, the hair dryer 10 is configured to automatically resume operation in whichever mode the switches 26, 28 are in.

Importantly, the switches 34, 36 are positioned or located on the hair dryer 10 so that they are actuated/depressed when the hair dryer 10 is placed between the knees of a user (e.g., by contact with the inside of a user's knees or legs). The switches 34, 36, therefore, provide for the automatic and momentary deactivation of the hair dryer 10 when the buttons are depressed by placing between a user's knees or legs, such as when a user desires to free up their hands to adjust hair or a manipulate a brush, hair clip, etc.

In an embodiment, the switches 34, 36 may be individually actuatable such that depression of only one of the switches 34, 36 is necessary to momentarily deactivate the hair dryer 10. This, similarly, allows for momentary deactivation of the hair dryer 10 when the hair dryer 10 is placed on its side a countertop or other surface, where only one switch may contact the countertop.

While the switches 34, 36 have been described herein as being configured as depressible buttons, the present invention is not so limited in this regard. In particular, in other embodiments, one or both of the switches 34, 36 may be touch sensors, e.g., capacitive and/or resistive touch sensors. In yet other embodiments, the switches 34, 36 may be optical sensors that may detect light and/or darkness, such that the hair dryer 10 remains in an active state when light is sensed, and is deactivated when light is prevented from reaching at least one of the sensors (such as when placed on a countertop or placed between the legs or knees of a user). In any implementation, the hair dryer 10 is configured to automatically resume operation in whichever mode the switches 26, 28 are in once the hair dryer 10 is grasped again by the user. Moreover, while the hair dryer 10 is shown and described as containing a pair of switches 34, 36, it is contemplated that a single switch may be employed on only one side of the hair dryer 10. Still further, while the switches 34, 36 are shown as being located on the head portion 15 substantially directly above the handle 14, in other embodiments, the switches 34, 36 may be located on the lateral sides of the nozzle portion 16, or towards a rear portion of the head 15 where they can be actuated when placed on a countertop or held between the knees.

In an embodiment, the hair dryer 10 may also include a trigger button 38 located at the front, upper portion of the handle 14, just below the nozzle 16, in a position where it can be depressed with an index finger when grasping the hair dryer 10. The trigger button 38 is operatively connected to the side switches 34, 36 (e.g., through mechanical or electrical means) such that depression of the trigger button 38 activates the side switches 34, 36 to effect deactivation of the hair dryer 10 in the manner described above. The trigger button 38 is preferably spring biased and includes a detent mechanism such that, when depressed, it is captured in this position, thereby deactivating the hair dryer 10 (without continuous finger pressure being needed to maintain the deactivated state of the hair dryer 10). The trigger button 38 can then simply be pressed again to release it, and to automatically resume operation in whichever mode the switches 26, 28 are in. Importantly, thereof, the trigger button 38 allows for a more manual, on-demand, momentary deactivation of the hair dryer 10 in addition to the automatic, momentary deactivation functionality provided by the side switches 34, 36.

In connection with the above, the hair dryer 10 may include a control unit and processor, and associated electrical connections and/or control circuitry necessary to carry out the functions described herein. It is contemplated, however, that more simple electrical and mechanical connections between the switches 24, 26, 34, 36, button 38 and motor, fan, and/or heating elements may be used to carry out the functions described herein.

The present invention therefore provides a hair dryer that does not require a user to manually deactivate the hair dryer to cease flow of heat air before placing the hair dryer on a countertop or holding the hair dryer between the legs of the user. In particular, the side switches provide a mechanism whereby the flow of heated air from the nozzle is momentarily, and automatically, interrupted when the hair dryer 10 is held between the knees, or placed on a countertop or other surface. Having the side switches to momentarily shut the hair dyer off when the hair dryer is placed between the knees prevents the hair dryer from blowing undesirable streams of air at the use or the floor (depending on which direction the barrel is aimed when placing it between the knees). Also, a user may simply set the dryer down on its side on a table or countertop in order to free up hands momentarily, and then pick it up quickly afterwards. Accordingly, this temporary shut-off activated by the side switches is achieved even though the usual on/off switch remains in the "on" position.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A method of operating a hair dryer, comprising the steps of:

placing a fan switch in an operational position to initiate a flow of air from a nozzle portion of the hair dryer;

placing a heater switch in an operation position to heat the air; and contacting a side switch located on the nozzle portion or a head portion of the hair dryer with a surface or a leg of a user to effect actuation of the side switch;

wherein actuation of the side switch effects a momentary deactivation of the hair dryer despite the fan switch and the heater switch being in the operational position.

2. The method according to claim 1, further comprising the step of:

actuating a trigger button on a handle portion of the hair dryer to effect the momentary deactivation of the hair dryer when the fan switch and the heater switch being in the operational position.

3. The method according to claim 1, wherein:

the side switch is a pair of side switches located on opposing sides of the hair dryer.

4. The method according to claim 1, wherein:

the hair dryer is configured to automatically resume operation in a mode indicated by a position of the fan switch and the heater switch when an external bias on the side switch is removed.

5. The method according to claim 1, wherein:

the side switch is one of a spring-biased button, a capacitive or a resistive touch sensor or an optical sensor.

* * * * *